United States Patent [19]

Metz et al.

[11] Patent Number: 4,554,610

[45] Date of Patent: Nov. 19, 1985

[54] MAGNETIC GRIPPING DEVICE

[75] Inventors: Rudi Metz, Donzdorf; Herbert Scholl, Göppingen, both of Fed. Rep. of Germany

[73] Assignee: EMAG Mashinenfabrik GmbH, Salach, Fed. Rep. of Germany

[21] Appl. No.: 616,516

[22] Filed: Jun. 1, 1984

[30] Foreign Application Priority Data

Jun. 1, 1983 [DE] Fed. Rep. of Germany ..... 3319928

[51] Int. Cl.[4] ..... H01F 7/04

[52] U.S. Cl. ..... 361/144; 335/285; 335/295

[58] Field of Search ..... 361/143, 144, 145; 335/78–82, 285, 286, 289–291, 296

[56] References Cited

U.S. PATENT DOCUMENTS 3,316,514 4/1967 Radus et al. ..... 335/291

FOREIGN PATENT DOCUMENTS 644636 3/1964 Belgium ..... 335/78

1210744 10/1970 United Kingdom ..... 335/295

*Primary Examiner*—Harry E. Moose, Jr.

*Attorney, Agent, or Firm*—Peter K. Kontler

[57] ABSTRACT

A permanent magnet with a split magnetic flux conductor between the pole shoes serves to attract a magnetizable load to the pole shoes of an electromagnet whose pole shoes constitute extensions of the pole shoes of the permanent magnet and whose split magnetic flux conductor extends between the respective pole shoes in parallel with the other conductor. An armature is movable into the gap between the parts of the magnetic flux conductor of the permanent magnet or between the parts of the magnetic conductor of the electromagnet by a fluid-operated motor or by the application of d-c current of proper polarity to the exciting coils of the electromagnet. The permanent magnet ceases to attract the load to the pole shoes of the electromagnet when the armature is moved into the gap between the portions of the magnetic flux conductor of the electromagnet. The coils of the electromagnet are connected to a source of d-c current to energize the electromagnet and to attract the load, and with a source of a-c current to demagnetize the load. The armature is held in the gap of the magnetic flux conductor of the permanent magnet when the electromagnet is energized to attract the load. The influence of the permanent magnet upon the load is eliminated in response to movement of the armature into the gap of the magnetic flux conductor of the electromagnet.

17 Claims, 3 Drawing Figures

MAGNETIC GRIPPING DEVICE

BACKGROUND OF THE INVENTION

The present invention relates to devices for manipulating ferromagnetic objects, and more particularly to a magnetic load gripping device which can be used to lift or lower workpieces, to hold workpieces at a desired level or in a desired orientation, to transport workpieces between two or more different locations and/or to otherwise manipulate ferromagnetic commodities. Still more particularly, the invention relates to magnetic lifting and/or gripping devices of the type wherein a permanent magnet can attract a load in the event of failure of an electromagnet.

It is already known to combine permanent magnets and d-c electromagnets into load gripping, lifting or like devices. A drawback of such conventional devices is that, even though the permanent magnet is capable of attracting a load when the connection between the electromagnet and the energy source is interrupted and/or in the event of failure of the energy source, the permanent magnet cannot be disengaged from the load by remote control, i.e., if the electromagnet is inactive, the load continues to adhere to the permanent magnet.

OBJECTS AND SUMMARY OF THE INVENTION

An object of the invention is to provide a novel and improved load lifting and/or gripping device which is constructed and assembled in such a way that the permanent magnet can attract a load in the event of failure of the electromagnet and that the permanent magnet can be disengaged from the load independently of the electromagnet.

Another object of the invention is to provide a device of the above outlined character which can be designed to attract and hold or attract and transport loads of any desired size and/or shape with a high degree of reliability and through any desired distance.

A further object of the invention is to provide a device which can be operated by remote control irrespective of the condition of its electromagnet.

An additional object of the invention is to provide a novel and improved method of manipulating loads with a device of the above outlined character.

Still another object of the invention is to provide a method of demagnetizing the load subsequent to completed manipulation by the above outlined device.

A further object of the invention is to provide a novel and improved permanent magnet for use in the above outlined device.

Another object of the invention is to provide a novel and improved electromagnet for use in the above outlined device.

Still another object of the invention is to provide novel and improved means for operating the about outlined device by remote control.

An additional object of the invention is to provide a novel and improved mobile armature for use in the above outlined device.

One feature of the invention resides in the provision of a device for manipulating magnetizable loads, such as ferromagnetic workpieces. The improved device comprises a permanent magnet having two pole shoes and a first magnetic flux conductor which is connected with the pole shoes and defines a first gap, an electromagnet having two pole shoes constituting extensions of the pole shoes of the permanent magnet and a magnetic flux conductor connected to the pole shoes of the electromagnet in parallel with the first conductor and defining a second gap, and an armature which is movable between a first position in which it fills only the first gap and contacts the first conductor at both sides of the first gap and a second position in which it fills only the second gap and contacts the second conductor at both sides of the second gap.

The improved manipulating device further comprises means for moving the armature between the two positions. Such moving means can comprise a coil within the confines of the permanent magnet and means for supplying the coil with d-c current of first polarity to thereby effect a movement of the armature to its first position or with d-c current of second polarity to thereby effect a movement of the armature to the second position. Alternatively or in addition to the just described coil, the means for moving the armature can comprise a source of d-c current which is connected with the exciting coil means of the electromagnet and means for supplying to the exciting coil means current of first polarity to there by effect a movement of the armature to one of its positions or second polarity to thereby effect a movement of the armature to the other position. Still further, or in lieu of the aforementioned moving means, the moving means can comprise motor means (e.g., a fluid-operated motor) for moving the armature between its first and second positions.

The pole shoes and/or the conductor of the electromagnet can comprise or constitute packages of laminations. In such manipulating device, the exciting coil means of the electromagnet is preferably connectable with a source of d-c current or with a source of a-c current.

Means can be provided for establishing a magnetic field between the pole shoes of the electromagnet independently of the second conductor to thereby counteract the effect of the stray field of the permanent magnet. Such establishing means can comprise a second permanent magnet which is out of contact with the pole shoes of the electromagnet. Alternatively, the establishing means can comprise a yoke which is actually connected to the pole shoes of the electromagnet.

Another feature of the invention resides in the provision of a method of engaging, attracting and releasing a magnetizable load by the aforedescribed improved manipulating device. The method comprises the steps of moving the armature into the first gap, contacting the load by the pole shoes of the electromagnet prior, during or subsequent to movement of the armature into the first gap, applying to the exciting coil means of the electromagnet d-c current so as to effect an addition of the resulting magnetic field of the electromagnet to the magnetic field of the permanent magnet and to thus attract the load to the pole shoes of the electromagnet, terminating the application of d-c current to the coils, and moving the armature into the second gap (e.g., simultaneously with the termination of application of d-c current) to thereby terminate the attraction between the load and the pole shoes of the electromagnet.

An additional feature of the invention resides in the provision of a method of demagnetizing a magnetizable load by a device of the above outlined character. Such method comprises the steps of contacting the load by the pole shoes of the electromagnet, applying to the coils d-c current to thereby energize the electromagnet and enable its pole shoes to attract the load, using the device to deposit the load on a support, terminating the application of d-c current to the coil means of the electromagnet and moving the armature into the second gap, applying a-c current to the coil means, reducing the field strength of the electromagnet to zero, and maintaining the pole shoes of the electromagnet in intimate contact with the load, at least during the initial stage of the application of a-c current. The field strength reducing step can include reducing the strength of the a-c current and/or moving the pole shoes of the electromagnet and the load relative to and away from each other.

The novel features which are considered as characteristic of the invention are set forth in particular in the appended claims. The improved device itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
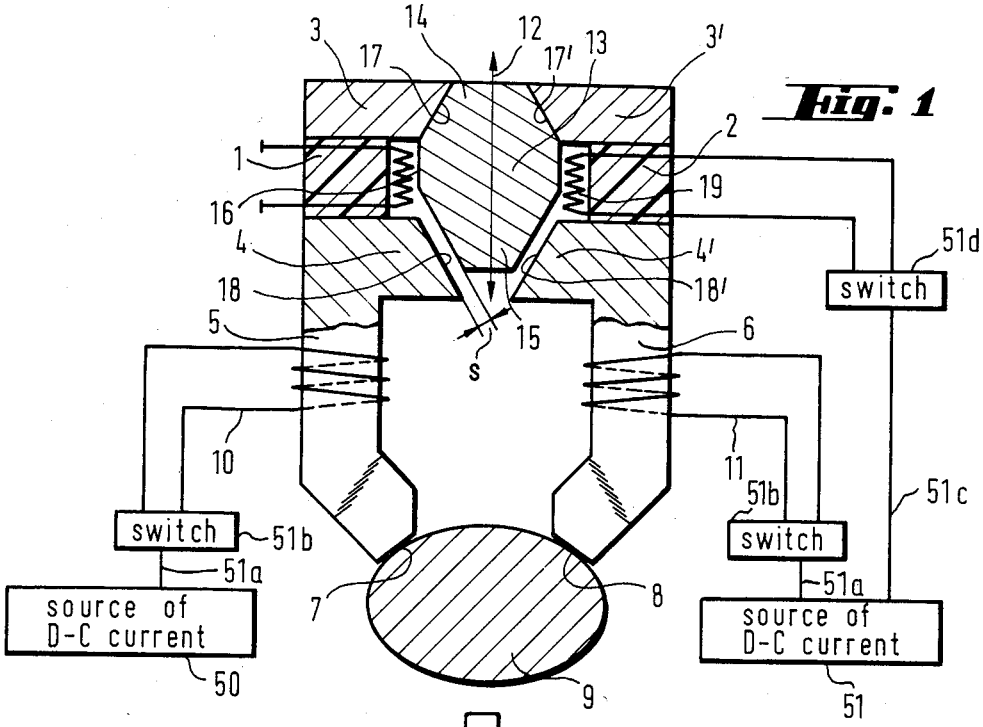
FIG. 1 is a partly elevational and partly sectional view of a magnetic gripping device which embodies one form of the invention, with the armature disposed in the gap between the portions of the conductor of the permanent magnet and with a ferromagnetic load attracted to the pole shoes of the electromagnet.

Referring to the drawing in detail, there is shown a magnetic gripping, lifting and transporting device which comprises a permanent magnet and an electromagnet. The purpose of the device is to selectively attract, lift, transport and/or deposit and deenergize a load 9, e.g., a piece of ferromagnetic material. The permanent magnet comprises two pieces 1 and 2 of magnetic alloy which constitute two discrete pole shoes and are connected with the respective halves 3 and 3' of a conductor which defines a return path for magnetic flux of the permanent magnet. The electromagnet of the improved device comprises a second two-piece conductor 4, 4' whose components are in contact with the respective shoes 1, 2 and are respectively integral with the pole shoes 5, 6 of the electromagnet. The portions 4, 4' of the conductor and the pole shoes 5, 6 of the electromagnet constitute or comprise packages of laminations of the type used in transformers. The free end faces or tips 7, 8 of the respective pole shoes 5, 6 of the electromagnet are arranged to contact the load 9, and their configuration can be such that they can be brought into requisite surface-to-surface contact with the load. The illustrated load has an oval cross-sectional outline and, therefore, the pole shoes 5, 6 have complementary concave end faces 7, 8. It will be noted that the general planes of the end faces 7, 8 are inclined relative to each other.

The pole shoes 5 and 6 of the electromagnet are respectively surrounded by exciting coils 10 and 11 which are connectable with a source 50 of a-c current or with a source 51 of d-c current. The connections are respectively indicated at **50*a*, 51*a* and they contain suitable switches 50*b*, 51*b* which can be actuated by hand or by remote control. The aforediscussed construction of the pole shoes 5, 6 and portions 4, 4' of the conductor of the electromagnet as packages of laminations is preferred at this time due to the fact that the coils 10, 11 are connectable with sources 50,51 of a-c or d-c current. Such design of the parts 4, 4', 5, 6 of the electromagnet entails a pronounced reduction or elimination of losses which would develop as a result of resort to a-c or d-c current in the absence of laminar design of the parts 4, 4', 5 and 6**.

Figure 2:
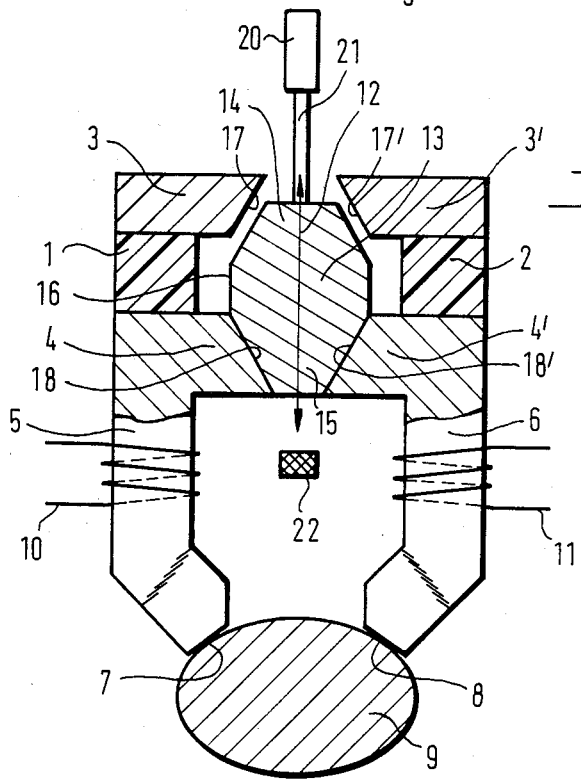
FIG. 2 is a similar partly elevational and partly sectional view of a magnetic gripping device wherein the armature is movable between its two end positions by a fluid-operated motor and wherein the stray field of the permanent magnet is neutralized by a second permanent magnet between the pole shoes of the electromagnet.
Figure 3:
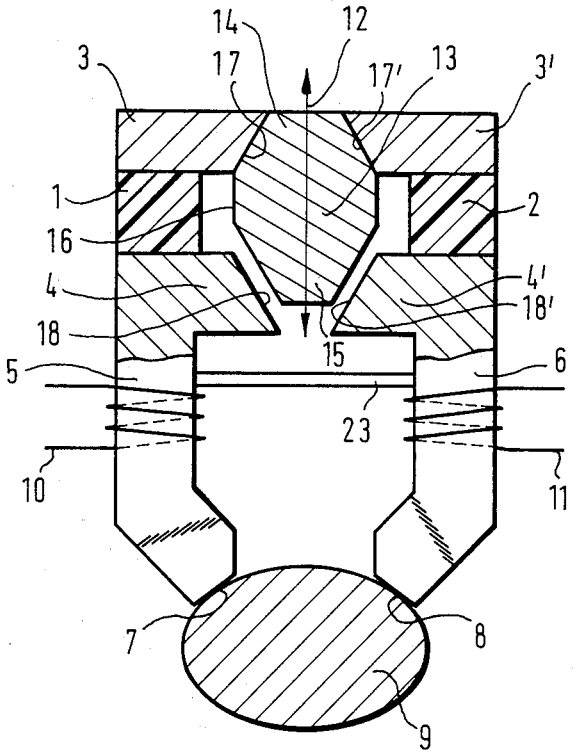
FIG. 3 is a similar partly elevational and partly sectional view of a magnetic gripping device wherein the second permanent magnet is replaced with a yoke which is directly connected to the pole shoes of the electromagnet.

The device of FIGS. 1 to 3 further comprises an armature 13 which is reciprocable in the directions indicated by a double-headed arrow 12, namely in the direction of the common symmetry axis of the two magnets. This armature is movable between a first end position which is shown in FIGS. 1 and 3 and in which it is in intimate contact with the portions 3, 3' of the conductor of the permanent magnet so that the armature then cooperates with the portions 3, 3' to complete a path for magnetic force lines between the poles 1 and 2 of the permanent magnet across the gap between the mirror symmetrical facets 17, 17' of the portions 3 and 3'. The respective wedge-like end portion 14 of the armature 13 has two facets which are respectively complementary to and contact the facets 17, 17' when the armature is moved to the end position of FIGS. 1 and 3.

The armature 13 is further movable to a second end position which is shown in FIG. 2 and in which its wedge-like lower end portion 15 is in surface-to-surface contact with the mutually inclined mirror symmetrical facets 18, 18' of the portions 4, 4' of the conductor of the electromagnet. The provision of wedge-shaped end portions 14, 15 ensures that the armature 13 can be moved into requisite surface-to-surface contact with the respective conductors. The median portion 16 of the armature 13 is bounded by pairs of parallel facets. The wedge-like shape of the end portions 14, 15 is desirable because this contributes to the formation of larger facets 17, 17', 18, 18' and corresponding facets on the armature as well as to more reliable large-area contact between the armature 13 and the conductor of the permanent magnet or electromagnet, depending upon the selected end position of the armature.

The means for moving the armature 13 between the two end positions can be constructed in a number of different ways. The source 51 of d-c current and the parts **51*a*, 51*b* constitute one such moving means. If the switch 51*b* is actuated to supply the exciting coils 10, 11 with current of a first polarity, the armature 13 is compelled to move to one of the two end positions, and the armature is moved to the other end position in response to the movement of switch 51*b* to a second position in which the coils 10, 11** receive a-c current of opposite polarity.

Another means for moving the armature 13 between its two end positions includes a coil 19 which is disposed in the permanent magnet and is connectable with the source 51 or with a discrete a-c current source by conductor means 51*c* containing switch means 51*d* arranged to supply to the additional coil 19 current of first or second polarity. This also entails a movement of the armature 13 to the one or the other end position. The coil 19 surrounds the armature 13 and is disposed in the region between the pole shoes 1, 2 of the permanent magnet.

FIG. 2 shows a third means for moving the armature 13 between the two end positions. Such moving means comprises a fluid-operated (hydraulic or pneumatic) motor having a double-acting cylinder 20 and a piston rod 21 connected to the armature 13. The system of valves which regulate the flow of a gaseous or hydraulic fluid into and from the chambers of the cylinder 20 is conventional and is not shown in FIG. 2.

The distance between the conductor 3, 3' and the conductor 4, 4' as well as the dimensions of the armature 13 are selected in such a way that the end portion 14 or 15 of the armature 13 defines with the one or the other conductor a gap s of preselected width.

The mode of operation is as follows:

In order to attract and hold a load (such as the illustrated load 9), the device is moved to the position of FIG. 1 so that the end faces 7, 8 of the pole shoes 5, 6 of the electromagnet move into preferably substantial contact with the adjacent portions of the load. In the next step, the switch 51*b* is actuated to apply to the coils 10, 11 a short-lasting d-c current impulse in order to make sure that the armature 13 remains in or is moved to the end position which is shown in FIGS. 1 and 3. In the next step, the switch 51*b* is moved to or is maintained in a position such that the coils 10, 11 receive d-c current of a polarity which is required to ensure that the magnetic field of the permanent magnet including the parts 1, 2, 3 and 3' is added to or superimposed upon the magnetic field of the electromagnet including the parts 4, 4', 5, 6, 10 and 11. This ensures that the armature 13 remains in the end position of FIGS. 1 or 3 and that the load 9 is strongly attracted by the pole shoes 5, 6 of the electromagnet. The device is then moved (if necessary) to another location, e.g., from one treating station to another treating station within a machine tool or from one machine tool to another.

The strength of the permanent magnet is selected with a view to ensure that the pole shoes 5, 6 continue to attract the load 9 even if the connection between the energy source 51 and the coils 10, 11 of the electromagnet is interrupted. It is further within the purview of the invention to employ a permanent magnet whose strength suffices not only to attract a lifted load 9 to the pole shoes 5, 6 irrespective of whether or not the coils 10, 11 are connected with the energy source 51 but also to actually lift the load 9 off the ground, off a conveyor, off a table or off any other suitable support on which the load (e.g., a metallic workpiece) rests prior to lifting by the improved gripping device.

In order to deposit the load 9 on a suitable support, the improved gripping device is operated as follows: The device is caused to place the load 9 into contact with the selected support and the switch 51*b* is caused to open the circuits of the coils 10 and 11 and to thereupon apply to these coils a d-c current of opposite polarity. It is clear that the change in polarity of d-c current can be effected without opening the circuit of the coils 10 and 11. This entails a movement of the armature 13 to the end position of FIG. 2 in which the gap between the portions 3, 3' of the conductor of the permanent magnet is reestablished and the gap between the portions 4, 4' of the conductor of the electromagnet is closed by the end portion 15 of the armature 13. This terminates the influence of the permanent magnet upon the load 9 so that the gripping device can be lifted above and away from the load which remains on its selected support.

In order to demagnetize the load 9 subsequent to termination of the influence of the permanent magnet and subsequent to deenergization of the electromagnet, the switch 50*b* is actuated to connect the coils 10, 11 with the source 50 of a-c current and to effect a gradual reduction of the magnetic field from a preselected initial value to zero. This can be effected by appropriate reduction of the strength of the a-c current and/or by moving the gripping device away from the load 9. In the course of the demagnetizing operation, the armature 13 dwells in the end position of FIG. 2.

In order to eliminate the influence of the stray field of the permanent magnet upon the demagnetizing operation, the improved gripping device can be further provided with a second permanent magnet 22 (note FIG. 2) which is disposed between and is out of contact with the pole shoes 5, 6 of the electromagnet. Alternatively or in addition to the permanent magnet 22, the means for eliminating the influence of the stray field can comprise a direct short-circuiting yoke 23 (FIG. 3) which extends between and is in actual contact with the pole shoes 5, 6 of the electromagnet. The magnetic field of the permanent magnet 22 is such that it opposes the action of the stray field of the permanent magnet and thus prevents the stray field from interfering with the demagnetizing operation. The function of the yoke 23 is analogous, except that it performs the same function by short-circuiting the stray field so that the latter is not effective in the region of the end faces 7 and 8.

It will be readily appreciated that the various features which are shown in FIGS. 1, 2 and 3 can be combined in one and the same gripping device or that they can be used individually in discrete gripping devices. Thus, the coil 19 can be used in the device of FIG. 2 in lieu of the motor 20, 21; the yoke 23 can be used in FIG. 2 in lieu of the permanent magnet 22; the motor 20, 21 and the coil 19 can be used in one and the same device so that one thereof constitutes a safety feature which is resorted to when the other is out of commission; the end faces 7, 8 of the pole shoes 5, 6 of the electromagnet can be configurated in any one of a practically infinite number of different ways to properly contact and attract loads of different sizes and/or shapes; the electromagnet can be disposed at a level above the permanent magnet, and so forth.

An important advantage of the improved load manipulating device is that its operation can be controlled in a simple and effective way by the expedient of applying proper current or terminating the application of current to the coils 10, 11 and by effecting a movement of the armature 13 to the proper end position. As mentioned above, the means for moving the armature 13 to the selected end position can be constructed and assembled in any one of several ways. When the armature 13 is held in the end position of FIG. 2, the device comprises two oriented pole shoes, namely those of the permanent magnet and those of the electromagnet. At such time, the influence of the permanent magnet upon the electromagnet is greatly reduced or is down to zero. If the armature 13 is moved to the position of FIG. 1 or 3, the action of the electromagnet is added to the action of the permanent magnet as long as the electromagnet remains energized. This is the optimum condition of the improved device for the lifting, attraction and transport (if necessary) of a magnetizable load. The coil 19 of FIG. 1 constitutes a very simple and effective means for effecting a movement of the armature 13 to the position of FIG. 1 or 2; all that is necessary is to provide a source of d-c current (such as the source 51 or a separate source) and proper means for connecting the source with the coil 19 in such a way that the coil can receive current of first or second polarity. As mentioned above, the same result can be obtained by omitting the coil 19 and by utilizing the exciting coils 10, 11 of the electromagnet for achieving a movement of the armature 13 to the end position of FIG. 1 or 2. The motor 20, 21 constitutes but one form of means for mechanically moving the armature 13 to the one or the other end position. This motor can be provided in addition to the aforementioned moving means to be put to use in the event of current failure.

It will be seen that the improved device renders it possible to control the permanent magnet independently of the electromagnet in such a way that the permanent magnet either acts or does not act upon the pole shoes 5, 6 of the electromagnet. Thus, the device can lift a load by resorting to the permanent magnet alone, and it can also deposit or release a load independently of the condition of the electromagnet.

Another important advantage of the improved device is that it can be used to demagnetize a ferromagnetic load. All that is necessary to assemble the components of the electromagnet in such a way that the exciting coils 10, 11 can be connected with a source (50) of a-c current or with a source (51) of d-c current. As mentioned above, this can be achieved in a very simple way by assembling the pole shoes and/or the conductor 4, 4' of the electromagnet from packages of laminations of the type well known from the art of transformers. In order to demagnetize the load, the end faces 7, 8 of the pole shoes 5, 6 remain in intimate contact with the load, the coils 10, 11 are disconnected from the energy source 51, the armature 13 is caused to assume the position of FIG. 2 (to eliminate the influence of the permanent magnet), the coils 10, 11 are connected to the energy source 50, and the strength of the magnetic field of the electromagnet is reduced to zero by reducing the strength of the applied a-c current and/or by moving the device away from the load and/or vice versa. The strength of the magnetic field of the electromagnet can be reduced to zero gradually or abruptly. Intimate contact between the load 9 and the pole shoes 5, 6 is maintained at least during the initial stage of reduction of the strength of the magnetic field of the electromagnet for the purposes of demagnetization of the load. It will be noted that demagnetization of the load is possible as a direct result of the aforedescribed design of the improved device, namely of the feature that the effect of the permanent magnet upon the load can be interrupted or eliminated by the novel expedient of moving the armature 13 to the position of FIG. 2. In the absence of such movability of the armature 13 to the position of FIG. 2, the permanent magnet would interfere with demagnetization of the load. Moreover, an attempt to demagnetize the load could damage or destroy the permanent magnet.

An additional important advantage of the improved device is the provision of means (22 and/or 23) for counteracting the influence of the magnetic stray field of the permanent magnet. The magnet 22 counteracts the stray field whereas the yoke 23 short-circuits such stray field between the pole shoes 5 and 6.

As already explained above, the manipulation of a load 9 with resort to the device of FIGS. 1, 2 or 3 can be carried out by remote control by causing the armature 13 to move to the position of FIG. 1 or 3 and by applying d-c current to the exciting coils 10, 11 in such a way that the magnetic field of the electromagnet is added to the magnetic field of the permanent magnet whereby the load is attracted with maximum force. In order to deposit the load on a selected support, the electromagnet is deenergized and the armature 13 is moved to the position of FIG. 2 to interrupt the magnetic field between the portions 3, 3' of the conductor forming part of the permanent magnet. The manner in which the armature 13 can be shifted between the position of FIGS. 1 or 3 and the position of FIG. 2 has been explained above, i.e., with resort to the coil 19, with resort to the motor 20, 21 or an equivalent motor, or with resort to the application of a d-c impulse to the exciting coils 10, 11 of the electromagnet.

In order to carry out the aforediscussed demagnetizing operation, the improved device is again actuated by remote control to deposit the ferromagnetic load 9 on a selected support, to interrupt the connection between the coils 10, 11 and the source 51 of d-c current, to move the armature 13 to the end position of FIG. 2, to apply a-c current to the coils 10, 11 of the electromagnet, and to thereupon reduce to zero the field strength of the electromagnet, either by gradually reducing to zero the strength of the applied a-c current, by increasing the distance between the load and the electromagnet or by resorting to each of these expedients at the same time. As also mentioned above, the end faces 7, 8 of the pole shoes 5, 6 should remain in intimate contact with the load, at least during the initial stage of reduction of the field strength of the electromagnet to zero. This is desirable and advantageous in order to ensure the establishment of magnetic flux through the load without gap leakage.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A device for manipulating magnetizable loads, comprising a permanent magnet having two pole shoes and a first magnetic flux conductor connected with said pole shoes and defining a first gap; an electromagnet having two pole shoes constituting extensions of the pole shoes of said permanent magnet and a magnetic flux conductor connected to the pole shoes of said electromagnet in parallel with said first conductor and defining a second gap; and an armature movable between a first position in which it fills only said first gap and contacts the first conductor at both sides of the first gap, and a second position in which it fills only said second gap and contacts the second conductor at both sides of such second gap.

2. The device of claim 1, further comprising means for moving said armature between said positions.

3. The device of claim 2, wherein said moving means comprises a coil within the confines of said permanent magnet and means for supplying said coil with d-c current of first polarity to thereby effect a movement of said armature to said first position or second polarity to thereby effect a movement of said armature to said second position.

4. The device of claim 1, wherein said electromagnet further comprises exciting coil means and further comprising means for supplying to said coil means d-c current of first polarity to thereby effect a movement of said armature to one of said positions or second polarity to thereby effect a movement of said armature to the other of said positions.

5. The device of claim 1, further comprising motor means for moving said armature between said positions.

6. The device of claim 5, wherein said motor means comprises a fluid-operated motor.

7. The device of claim 1, wherein the pole shoes of said electromagnet include packages of laminations.

8. The device of claim 1, wherein the conductor of said electromagnet includes a package of laminations.

9. The device of claim 1, wherein the pole shoes and the conductor of said electromagnet include packages of laminations and said electromagnet comprises exciting coil means, and further comprising sources of a-c and d-c current and means for connecting said coil means with one of said sources at a time.

10. The device of claim 1, further comprising means for establishing a magnetic field between the pole shoes of said electromagnet independently of said second conductor to thereby counteract the stray field of said permanent magnet.

11. The device of claim 10, wherein said establishing means comprises a second permanent magnet which is out of contact with the pole shoes of said electromagnet.

12. The device of claim 10, wherein said establishing means comprises a yoke which connects the pole shoes of said electromagnet to one another.

13. A method of engaging, attracting and releasing a magnetizable load by a device having a permanent magnet with two pole shoes and a first magnetic flux conductor which is connected with the pole shoes and defines a first gap, an electromagnet having two pole shoes constituting extensions of the pole shoes of the permanent magnet and a magnetic flux conductor connected with the pole shoes of the electromagnet in parallel with the flux conductor of the permanent magnet and defining a second gap, with exciting coils for the electromagnet, and with an armature which is movable into the first gap while being remote from the second gap and vice versa, comprising the steps of moving the armature into the first gap; contacting the load by the pole shoes of the electromagnet; applying to the coils d-c current so as to effect an addition of the resulting magnetic field of the electromagnet to the magnetic field of the permanent magnet and to thus attract the load to the pole shoes of the electromagnet; terminating the application of d-c current to the coils; and moving the armature into the second gap to thereby terminate the attraction between the load and the pole shoes of the electromagnet.

14. A method of demagnetizing a magnetizable load by a device having a permanent magnet with two pole shoes and a first magnetic flux conductor which is connected with the pole shoes and defines a first gap, an electromagnet having two pole shoes constituting extensions of the pole shoes of the permanent magnet and a magnetic flux conductor connected with the pole shoes of the electromagnet and defining a second gap, with exciting coils for the electromagnet, and with an armature which is movable into the first gap while being remote from the second gap and vice versa, comprising the steps of contacting the load by the pole shoes of the electromagnet; applying to the coils d-c current to thereby energize the electromagnet and enable its pole shoes to attract the load; using the device to deposit the load on a support terminating the application of d-c current to the coils and moving the armature into the second gap; applying to the coils a-c current; reducing the field strength of the electromagnet to zero; and maintaining the pole shoes of the electromagnet in intimate contact with the load, at least during the initial stage of the application of a-c current.

15. The method of claim 14, wherein said field strength reducing step includes reducing the strength of the a-c current.

16. The method of claim 14, wherein said field strength reducing step includes moving the pole shoes of the electromagnet and the load relative to and away from each other.

17. The method of claim 16, wherein said field strength reducing step further comprises reducing the strength of the a-c current.

* * * * *